US005691018A

United States Patent [19]

Kelley et al.

[11] Patent Number: 5,691,018

[45] Date of Patent: Nov. 25, 1997

[54] SILICONE MASK FOR THERMAL SPRAY COATING SYSTEM

[75] Inventors: Kurtis C. Kelley, Washington; Jack R. Davis; Karan J. Shane, both of Peoria, all of Ill.

[73] Assignee: Caterpillar Inc., Peoria, Ill.

[21] Appl. No.: 573,159

[22] Filed: Dec. 15, 1995

[51] Int. Cl.[6] ..... B05B 1/28

[52] U.S. Cl. ..... 428/36.8; 428/36.9; 524/588; 118/301; 118/69; 118/504

[58] Field of Search ..... 428/36.8, 36.9; 524/588; 118/504, 301, 69

[56] References Cited

U.S. PATENT DOCUMENTS 4,570,568 2/1986 Fair ..... 118/69

4,777,087 10/1988 Heeks et al. ..... 428/321.1

4,974,532 12/1990 March ..... 118/301

5,112,683 5/1992 Johansen ..... 428/354

5,508,097 4/1996 Hauser et al. ..... 428/252

*Primary Examiner*—Margaret W. Glass

[57] ABSTRACT

In an apparatus for thermally spraying a coating on a work piece, an improvement is disclosed. The improvement comprises a flexible elastomeric mask for protecting the apparatus. The mask is made from silicone rubber having a composition comprising, silicone polymer in the range of about 40% to about 70% by weight, and silica in the range of about 30% to about 60% by weight.

10 Claims, 1 Drawing Sheet

SILICONE MASK FOR THERMAL SPRAY COATING SYSTEM

TECHNICAL FIELD

The present invention relates generally to a mask for painting or spraying applications, and more particularly to a silicone mask for use with a thermal spray coating system.

BACKGROUND ART

Several well known high temperature thermal spray methods exist in the industry today, such as plasma spray and arc vapor deposition, for example. Plasma spray methods generally employ a high temperature, open flame into or through which, a metal or ceramic wire, rod, or powder form is heated, melted to form small discrete particles, and propelled from a gun or a torch assembly onto a work piece. Frequently plasma spray is used to deposit thick, durable coatings of metal or ceramic materials on metal or ceramic substrates, for example, thermal barrier coatings on engine components such as valves, heads, piston crowns, and cylinder walls. At other times, plasma spray is used to deposit durable, high quality, wear resistant coatings on critical wear components in an engine, such as bearing races, for example.

One problem with a plasma spray system is that the plasma spray does not always coat only those portions of the work piece which are desired to be coated. Depending upon the condition of the equipment, the spray material, spray parameters, and the dimensions of the work piece being treated, areas surrounding the work piece are inadvertently coated with the sprayed material to a varying degree. At the very least, this is uneconomical because it represents a waste of the sprayed material. More often, the excess over spray is a hindrance and looks unaesthetic. But at the very worst, protecting equipment and fixtures from the over spray becomes a critical problem. The additional over spray hinders the mechanical performance of the equipment and fixtures. The over spray can quickly build up on fixtures and equipment, causing extensive damage, and requiring long clean-up procedures or re-machining before re-use.

Previous methods of protecting the equipment from over spray have included painting the surfaces with a high temperature coating such as Nicrobraz Stop-Off®, or covering equipments parts with fiberglass tape. Neither of these methods are entirely successful because both are difficult to remove, hinder the movement of movable parts of the equipment, such as a chuck, have limited useful life, and still require extensive clean-up of the over spray.

Other methods have included a mask formed of metal, to cover the equipment and surrounding area. Unfortunately, such masks are difficult to make and represent a waste of time and labor.

Still other methods have utilized a plurality of laminated layers of adhesive, metal sheet, perforated metal sheet and a sacrificial polymer, all bonded together to form a cohesive laminate sheet that has to be die cut to form a mask. These masks are difficult to use because they are rigid and not flexible enough to install and remove from the equipment in an efficient manner. Making such masks represents a wasteful expense of time, labor and natural resources.

It has been desirable to have a mask for a thermal spray system that is easy to install, remove and clean. It has been further desirable to have a mask that can be installed on moving parts, such as robotic arms, for example and are flexible enough and durable enough to provide adequate protection to movable parts of the plasma spray equipment. It has still further been desirable to have a mask that does not accumulate over spray. Finally, it has been desirable to have a mask that combines all of the above desirable features and can also be magnetized for protecting isolated areas.

The present invention is directed to overcome one or more problems of heretofore utilized masks for thermal spray systems.

DISCLOSURE OF THE INVENTION

In one aspect of the present invention, in an apparatus for thermally spraying a coating on a work piece, an improvement is disclosed. The apparatus includes means spaced from the work piece for melting a coating material and propelling the molten coating material to a surface area on the work piece, means for directing a flow of gas at the coated surface area on the work piece, and means for rotating the work piece. The improvement comprises a flexible elastomeric mask for protecting the apparatus. The mask is made from silicone rubber having a composition comprising, silicone polymer in the range of about 40% to about 70% by weight, and silica in the range of about 30% to about 60% by weight.

In another aspect of the present invention, a high temperature resistant flexible elastomeric mask for thermal spray applications is disclosed. The mask comprises a hollow tubular cylinder having a closed end with a centrally located opening in the closed end. The tubular cylinder is made from silicone rubber which has a composition comprising, silicone polymer in the range of about 40% to about 70% by weight and silica in the range of about 30% to about 60% by weight.

BEST MODE FOR CARRYING OUT THE INVENTION

Figure 1:
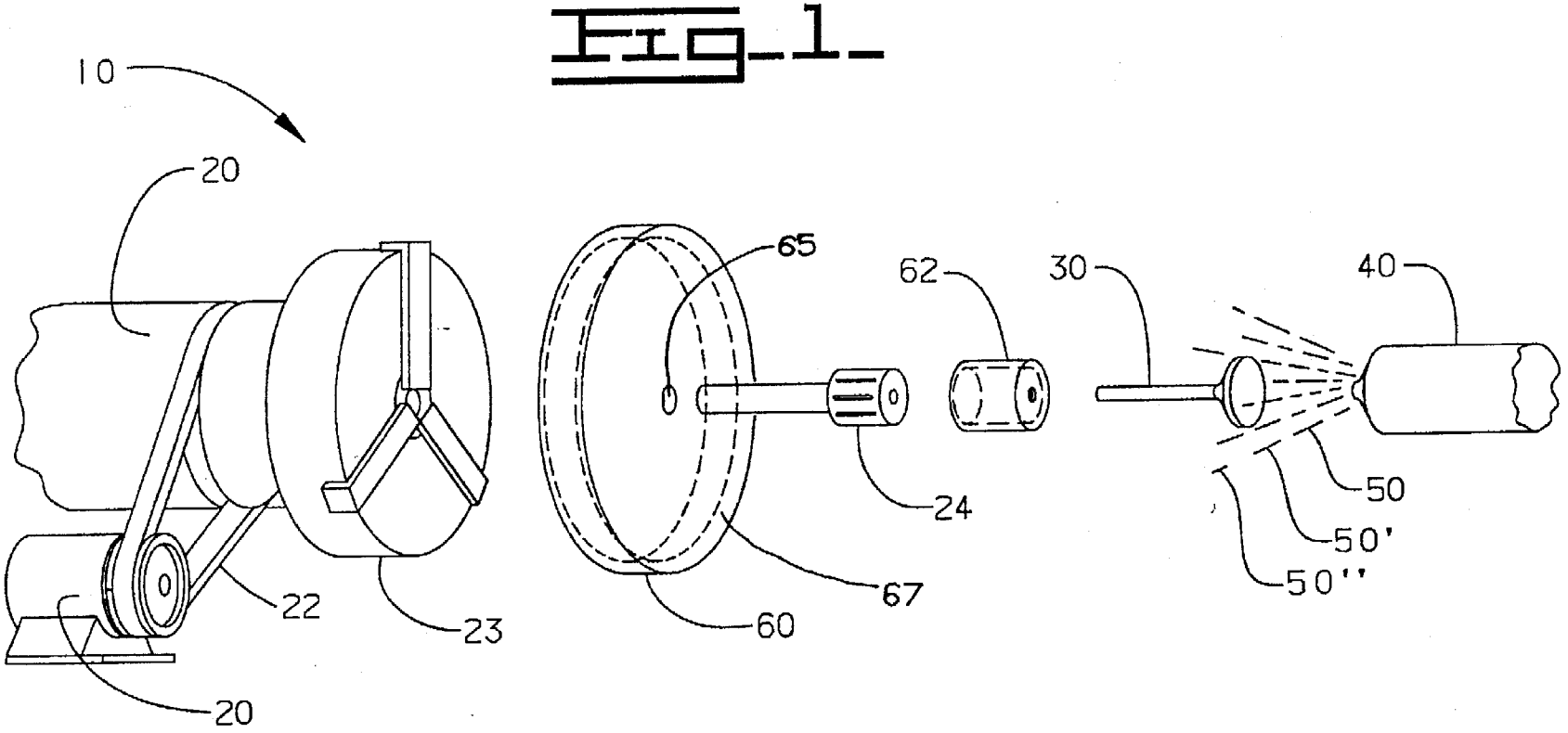
FIG. 1 is a partial view, in perspective, of an apparatus for thermally spraying a coating on a work piece, using the masks of the present invention for the protection of vital equipment parts and fixtures.

Referring to FIG. 1, a thermal spray apparatus 10 for thermally spraying a coating on a work piece is shown, in perspective. The apparatus 10 includes means such as a plasma spray gun 40 for generating a superheated gas plasma to melt a powder feedstock of a coating material injected into the plasma stream from a powder feed source. The melted feedstock particles are accelerated by the plasma stream to form a spray of molten coating material 50, 50' 50" and carried to a preselected surface 32 on the work piece 30. The work piece 30 is an engine valve typically having a plurality of surfaces 32. To reduce the thermal conductivity of an engine valve, a coating of a thermally insulating material is deposited on the valve face surface 32, by thermal spray methods. In this operation, the work piece 30, such as a valve, is mounted in a main rotatable fixture 23 and is turned about the longitudinal axis of the work piece 30. If the work piece 30 is too small, then it may be mounted in another rotatable fixture 24, such as a small chuck, which in turn is mounted in the main rotatable fixture 23, such as a large chuck. The rotatable fixture 23 is rotatably held in a device 20, and rotated by means 21, such as a motor and means 22, such as a pulley, for example. During the spraying operation, the plasma spray gun 40 is held stationary. Alternatively, if the work piece 30 is an elongated member which has to be coated along its longitudinal axis, the plasma spray gun 40 may be traversed back and forth along the length of the work piece 30.

In the preferred embodiment of the present invention, the apparatus 10 includes a flexible high temperature resistant elastomeric mask 60,62 (hereinafter referred to by the single numeral 60 for purposes of brevity) made of silicone rubber for protecting critical equipment parts such as a large chuck 23 and a smaller chuck 24 from the plasma over spray 50, 50', 50".

In one embodiment, the mask 60 has the shape of a hollow tubular cylinder having a closed end 67, and a centrally located opening 65 in the closed end 67. Other geometrical shapes can be made by molding the silicone rubber in appropriate molds for protecting equipment parts having various shapes.

In the preferred embodiment of the present invention, the mask 60 is made from silicone rubber having a composition comprising silicone polymer, desirably in the range of about 40% to about 70% by weight, and silica, desirably in the range of about 30% to about 60% by weight. Silicone polymer less than about 40% by weight and silica greater than about 60% by weight are undesirable because it would detrimentally lower the heat resistance of the silicone rubber, as well as reduce its flexibility and elasticity. Low elasticity is undesirable because the mask has to be elastic enough to be stretched and installed on the rotatable fixture 23,24. Silicone polymer greater than about 70% by weight and silica less than about 30% by weight are undesirable because it would reduce the durometer hardness and toughness of the silicone rubber and make it detrimentally susceptible to tearing. Preferably, the silicone rubber has a composition comprising, by weight, 54% vinyl silicone polymer, 35% quartz silica, 11% dimethylvinylated silica and 0.3% xylene.

In the preferred embodiment of the present invention, the silicone rubber desirably has an elongation of at least 200% at break and a tensile strength at 150% elongation of at least 500 psi. An elongation less than about 200% and a tensile strength of less than about 500 psi at 150% elongation is undesirable because it will detrimentally reduce the elasticity, flexibility and strength of the mask and reduce its resistance to cracking when it is used to protect movable parts such as robotic arms.

In the preferred embodiment of the present invention, the silicone rubber has a specific gravity at 25° C. desirably in the range of about 1.15 to about 1.40 and preferably, about 1.27. A specific gravity less than about 1.15 is undesirable because it will reduce the toughness of the mask to withstand high temperature plasma spray. A specific gravity greater than 1.40 is undesirable because it will cause the mask to be detrimentally too stiff.

In the preferred embodiment of the present invention, the silicone rubber has a durometer hardness desirably in the range of about 50 Shore A to about 70 Shore A, and preferably in the range of about 55 Shore A to about 60 Shore A. A hardness less than 50 Shore A is undesirable because the mask will be too soft to withstand the high velocity plasma spray particles impacting it and it may tear. A hardness greater than 70 Shore A is undesirable because the mask will be detrimentally too inelastic to adequately protect movable parts and also will not facilitate easy removal of the plasma over spray.

In the preferred embodiment of the present invention, the silicone rubber is cured by a curing agent having a composition comprising, by weight, 52% vinyl silicone polymer, 28% dimethyl methylhydrogen siloxane, 11% dimethylvinylated silica, 9% aluminum chromium cobalt oxide, and 0.3% xylene. Desirably, the silicone rubber is mixed with the curing agent in the ratio not greater than about 12:1 by weight, silicone rubber:curing agent, and preferably, about 10:1. A rubber:curative ratio greater than 12:1 is undesirable because it will detrimentally result in less cure, lower physical strength and a longer cure time. Although room temperature cure is sufficient, heat may be applied to reduce the curing time. Alternate types of silicone rubber can also be used to make silicone masks according to the present invention. For example, a silicon polymer base comprising polydimethylsiloxanedimethyl siloxane hydroxy and dimethyl siloxane can be used with silica, and cured with a curing agent comprising dubutyltin dilaurate, tetraethyl ester and ethyl polysilicate, according to the present invention.

EXAMPLE A

Silicone rubber masks according to the present invention were made by curing a silicone rubber having the composition by weight, 54% vinyl silicone polymer, 35% quartz silica, 11% dimethylvinylated silica and 0.3% xylene with a curative having a composition by weight, 52% vinyl silicone polymer, 28% dimethyl methylhydrogen siloxane, 11% dimethylvinylated silica, 9% aluminum chromium cobalt oxide, and 0.3% xylene. The silicone rubber of the above composition is manufactured by Dow Corning, having the trade name Silastic® M RTV Silicone Rubber. Various masks of varying shapes were made by pouring the silicone polymer/curative mixture at a 10:1 polymer:curative weight ratio, into suitable molds and curing at room temperature for 24 hours.

The resultant masks were used to protect various plasma spray equipment parts, such as a chuck for example. The silicone masks were exposed to plasma over spray of ceramic coatings, such as zirconia, yttria and the like. The masks did not accumulate very much over spray and any over spray that did deposit on the mask, popped off very easily by stretching the mask.

Industrial Applicability

The present invention is useful for protecting plasma spray equipment from plasma over spray. Particularly, the mask of the present invention is used to protect equipment such as the plasma spray gun, the robotic arms holding the plasma spray gun, and in particular, the rotatable device used for holding and rotating the work piece from the plasma over spray.

Other aspects, objects and advantages of this invention can be obtained from a study of the drawings, the disclosure and the appended claims.

We claim:

1. In an apparatus for thermally spraying a coating on a work piece, the apparatus including means spaced from the work piece for melting a coating material and propelling the molten coating material to a surface area on the work piece, means for directing a flow of gas at the coated surface area on the work piece, and means for rotating the work piece, the improvement comprising:

a flexible elastomeric mask for protecting said apparatus, said mask being a hollow tubular cylinder having a closed end with a centrally located opening in said closed end, said tubular cylinder being adapted for covering said means for rotating said work piece, said tubular cylinder being made from a filled silicone elastomer having a composition comprising;

silicone rubber in the range of about 40% to about 70% by weight of said silicone elastomer; and silica filler in the range of about 30% to about 60% by weight of said silicone elastomer;

said silicone rubber being prepared by curing a vinyl silicone polymer with a curing agent comprising a silicone polymer, dimethyl methylhydrogen siloxane, dimethylvinylated silica and xylene; and said tubular cylinder having an elongation of at least 200% at break.

2. An apparatus, as set forth in claim 1, wherein said silicone elastomer has a tensile strength at 150% elongation of at least 500 psi.

3. An apparatus, as set forth in claim 1, wherein said silicone elastomer has a specific gravity at 25° C. in the range of about 1.25 to about 1.30.

4. An apparatus, as set forth in claim 1, wherein said silicone elastomer has a durometer hardness in the range of 55 Shore A to about 60 Shore A.

5. An apparatus, as set forth in claim 1, wherein said silicone elastomer has a composition comprising, a rubber-filler mixture comprising, 54% vinyl silicone polymer, 35% quartz silica, 11% dimethylvinylated silica and 0.3% xylene by weight of said rubber-filler mixture, said rubber-filler mixture being cured by a curing agent having a composition comprising, 52% vinyl silicone polymer, 28% dimethyl methylhydrogen siloxane, 11% dimethylvinylated silica, 9% aluminum chromium cobalt oxide, and 0.3% xylene by weight of said curing agent, said rubber-filler and said curing agent being mixed in a weight ratio of about 10:1 rubber-filler to curing agent.

6. A high temperature resistant flexible elastomeric mask for protecting means for rotating a work piece in an apparatus for thermally spraying a coating on said work piece, comprising:

a hollow tubular cylinder having a closed end with a centrally located opening in said closed end, said tubular cylinder being adapted for covering said means for rotating said work piece and said tubular cylinder being made from silicone elastomer having a composition, comprising;

silicone rubber in the range of about to about 70% by weight of said silicone elastomer; and silica filler in the range of about 30% to about 60% by weight of said silicone elastomer;

said silicone rubber being prepared by curing a vinyl silicone polymer with a curing agent comprising a silicone polymer, dimethyl methylhydrogen siloxane, dimethylvinylated silica and xylene; and said silicone elastomer having an elongation of at least 200% at break.

7. A mask, as set forth in claim 6, wherein said silicone elastomer has a tensile strength at 150% elongation of at least 500 psi.

8. A mask, as set forth in claim 6, wherein said silicone elastomer has a specific gravity at 25° C. in the range of about 1.15 to about 1.40.

9. A mask, as set forth in claim 6, wherein said silicone elastomer has a durometer hardness in the range of 55 Shore A to about 60 Shore A.

10. A mask, as set forth in claim 6, wherein said silicone elastomer has a composition comprising, a rubber-filler mixture comprising, 54% vinyl silicone polymer, 35% quartz silica, 11% dimethylvinylated silica and 0.3% xylene by weight of said rubber-filler mixture, said rubber-filler mixture being cured by a curing agent having a composition comprising, 52% vinyl silicone polymer, 28% dimethyl methylhydrogen siloxane, 11% dimethylvinylated silica, 9% aluminum chromium cobalt oxide, and 0.3% xylene by weight of said curing agent, said rubber-filler and said curing agent being mixed in a weight ratio of about 10:1 rubber-filler to curing agent.

* * * * *

UNITED STATES PATENT AND TRADEMARK OFFICE

CERTIFICATE OF CORRECTION

PATENT NO. : 5,691,018

DATED : November 25, 1997

INVENTOR(S) : Kurtis C. Kelley, Jack R. Davis, Karan J. Shane

It is certified that error appears in the above-identified patent and that said Letters Patent is hereby corrected as shown below:

Column 5, line 5, insert -- vinyl -- before "silicone"
Column 5, line 7, delete "tubular cylinder" and insert -- silicone elastomer --
Column 6, line 4, insert -- 40% -- before " to"
Column 6, line 10, insert -- vinyl -- before "silicone"

Signed and Sealed this

Third Day of March, 1998

*Attest:*

*Attesting Officer*

BRUCE LEHMAN

*Commissioner of Patents and Trademarks*